US007322223B2

(12) United States Patent
Levers

(10) Patent No.: US 7,322,223 B2
(45) Date of Patent: Jan. 29, 2008

(54) CREEP FORMING A METALLIC COMPONENT

(75) Inventor: Andrew Levers, Chester (GB)

(73) Assignee: Airbus UK Limited, Bristol (GB)

( * ) Notice: Subject to any disclaimer, the term of this patent is extended or adjusted under 35 U.S.C. 154(b) by 458 days.

(21) Appl. No.: 10/477,228

(22) PCT Filed: Jul. 4, 2002

(86) PCT No.: PCT/GB02/03061

§ 371 (c)(1),
(2), (4) Date: Nov. 10, 2003

(87) PCT Pub. No.: WO03/006191

PCT Pub. Date: Jan. 23, 2003

(65) Prior Publication Data

US 2004/0154369 A1 Aug. 12, 2004

(30) Foreign Application Priority Data

Jul. 12, 2001 (GB) ..... 0117066.1

(51) Int. Cl.
*C22F 1/00* (2006.01)

(52) U.S. Cl. ..... 72/377; 148/695; 148/697

(58) Field of Classification Search ..... 72/377; 148/695, 697, 698

See application file for complete search history.

(56) References Cited

U.S. PATENT DOCUMENTS

| | | | | |
|---|---|---|---|---|
| 3,550,417 | A | 12/1970 | McMaster | |
| 3,550,422 | A | 12/1970 | Potter | |
| 3,739,617 | A | 6/1973 | Stejskal | |
| 3,879,974 | A | 4/1975 | Biddell et al. | |
| 3,910,085 | A | 10/1975 | Biddell et al. | |
| 3,945,231 | A | 3/1976 | Imazu et al. | |
| 4,072,262 | A | 2/1978 | Godrick et al. | |
| 4,188,811 | A | 2/1980 | Brimm | |
| 6,212,929 | B1 | 4/2001 | Binhack | |
| 6,242,715 | B1 | 6/2001 | Bichon et al. | |
| 6,264,771 | B1 * | 7/2001 | Bornschlegl et al. | 148/710 |

FOREIGN PATENT DOCUMENTS

| | | | |
|---|---|---|---|
| DE | 24 00 554 A | | 7/1975 |
| DE | 197 51 035 A | | 5/1999 |
| EP | 0 390 355 A | | 10/1990 |
| EP | 0 448 339 A | | 9/1991 |
| GB | 1 208 729 A | | 10/1970 |
| GB | 1208729 | * | 10/1970 |
| GB | 2 073 631 A | | 10/1981 |
| GB | 2 360 236 A | | 9/2001 |

OTHER PUBLICATIONS

"www.wordiq.com/definition/Radio".*

* cited by examiner

*Primary Examiner*—Roy King
*Assistant Examiner*—Janelle Morillo
(74) *Attorney, Agent, or Firm*—Nixon & Vanderhye P.C.

(57) ABSTRACT

A method of creep forming a metallic component is provided. The method includes the steps of applying static loading and cyclic loading and/or vibration to the component during the creep forming thereof to act as a source of additional energy.

15 Claims, 4 Drawing Sheets

CREEP FORMING A METALLIC COMPONENT

This application is the US national phase of international application PCT/GB02/03061 filed 4 Jul. 2002, which designated the US. PCT/GB02/03061 claims priority to GB Application No. 0117066.1, filed 12 Jul. 2001. The entire contents of these applications are incorporated herein by reference.

This invention relates to the creep forming of metallic components.

Creep forming of metallic components by which a component such as an aluminium alloy plate is laid on a former and heated while the plate slowly takes up the form of the former is well known.

This technique suffers from the disadvantage that forming can take a long time, the tooling can be complex in shape to allow the correct profile to be formed and factors such as springback must be taken into account, requiring further processing steps and therefore can be uneconomic. Also the accuracy of formation can sometimes be inadequate, leading, for example, to the inability to produce large components of complex shape such as aluminium alloy wingskin panels, where errors in the shape formed accumulate over the length of the component to unacceptable levels above the required tolerances.

It is an object of the invention to provide an improved method of creep forming metallic components.

According to the invention there is provided a method of creep forming a metallic component including the steps of applying a static loading and a cyclic loading to the component during the creep forming thereof. It is preferred that the magnitude of the cyclic loading is much smaller than the magnitude of the static loading. The magnitude of the cyclic loading maybe less than or equal t 10% of the magnitude of the static loading, more preferably it may be less than 5%. In the experiments reported in this specification the magnitude of the cyclic loading is less than 2% of the magnitude of the static loading. Indeed it is less than 1%. A portion of the cyclic loading may be vibration.

The application of cyclic loading to components, artifacts, or structures as an additional energy source during creep forming is believed to accelerate permanent deformation experienced by the components and thus reduce springback. This is seen as a substantial advancement on the prior art.

Allowing large components to be creep formed without an unacceptable accumulation of error on the formed shape, tooling to be kept relatively simple and forming times to be reduced, thus making the process more economical. Excitation may be applied both globally and locally to components, artifacts, or structures in either static or dynamic (adaptive) processing.

Methods of Application

Application of cyclic loading/vibration may be made either to a localised component area, or to a whole component, depending upon size and specific forming requirements. Incremental application of the technique across a component will enable components of any dimension to be treated. Components such as aircraft wing skins, stringers, spars, fuselage frames, fuselage panels etc. may be formed using this technique.

The technique is envisaged to be useful at any frequency over one cycle/hour.

Preferably frequencies of 20 Hz-10,000 Hz are used.

In principal this technique may be used regardless of component material for example with steels, titanium or aluminium and titanium and aluminium alloys. For some materials including the 2000, 6000, 7000, and 8000 aluminium alloys cyclic loading can be applied as a supplement to conventional heating sources to increase strain retention during creep forming.

For materials where vibration/cyclic loading can be applied as a supplement to conventional heating sources to increase strain retention during creep forming this opens the exciting possibility of forming these materials to the end required shape without further precipitation hardening and thus negating the need for further heat treatment. Thus allowing the forming process to take place during the last stage of heat treatment.

There are six major advantages of this technique:

1. An increase in strain retention during conventional or adaptive processing at normal forming temperatures over conventional heating when used alone.
2. The ability to creep form materials, including 2000, 6000, 7000 and 8000 aluminium alloys in the final heat treatment stage for example, 2024 aluminium alloy with a combination of conventional heating to relatively low temperatures (up to 100° C.) with an additional vibration/cyclic loading.
3. Improved accuracy in final component shape as a direct result of the control over the vibration wave form within the artifact or component being processed.
4. Improved process speed at normal forming temperatures.
5. The ability to exercise forming zone control as a result of the local application of vibration/cyclic loading in thickened areas such as local reinforcements or integrally stiffened areas of components.
6. The ability to time curvature on large components such as large aircraft wing skins and stringers.

Equipment

Portable excitation equipment is preferably used in the case of local application of the technique to a discrete area of a component. Otherwise bespoke equipment may be used for large components, for example aircraft wing skin panels.

The invention will now be further explained by way of example only with reference to the accompanying drawings of which:

Experimental Data

Figure 1:
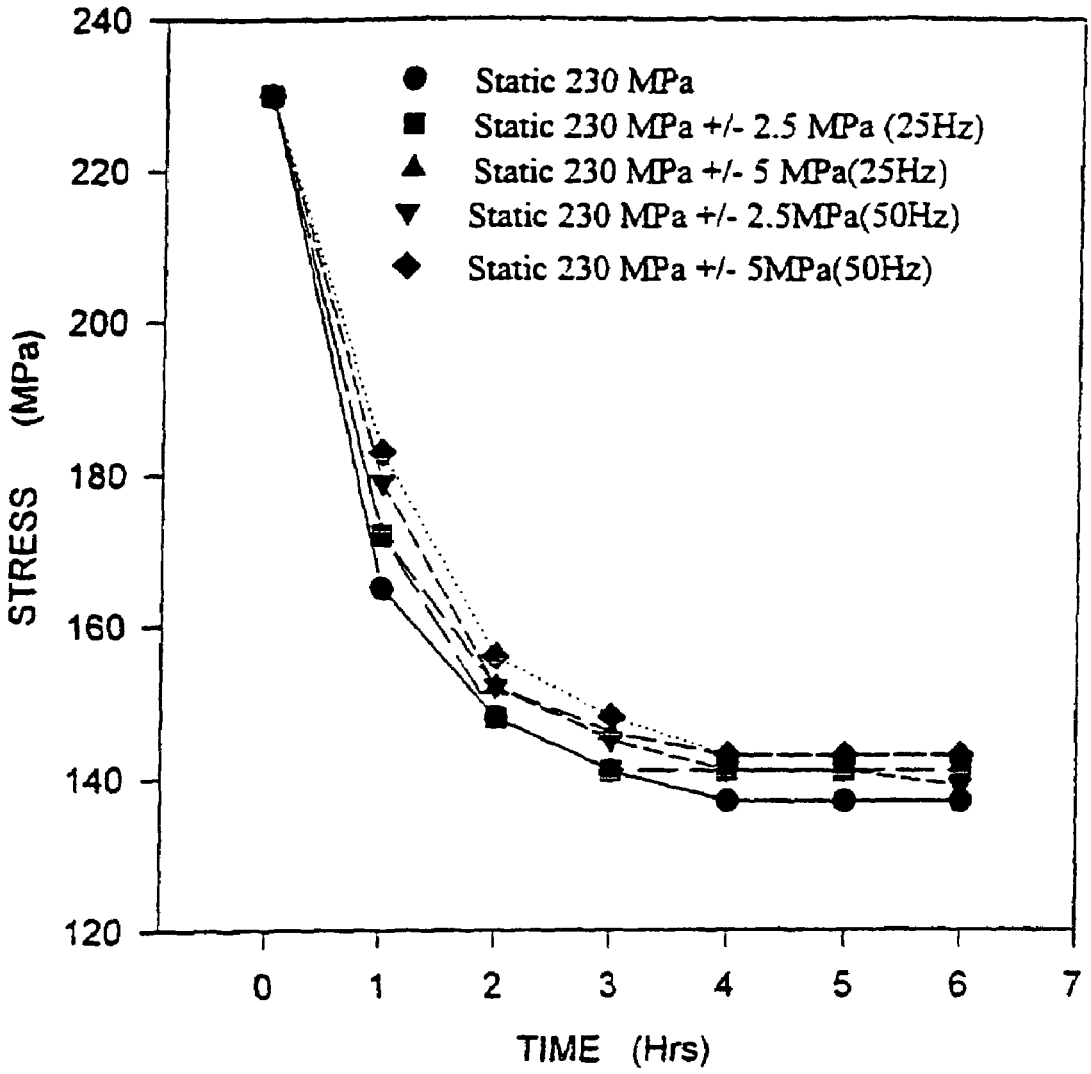
FIG. 1 is a graphical representation of the Stress Relaxation with Ageing Time results from displacement control tests carried out on 2024 T351 aluminium alloy for ten hours at 155° C. plus or minus 5° C.

There follows a description of the testing of bent-beam cyclic creep forming specimens for two aluminium alloys; 2024 T351 and 7150 W51 and the subsequent results.

Experimental Method

The tests involved the quantitative stressing of beam specimens by application of a four point bending stress using a servohydraulic cyclic instron machine. The applied stress was determined from the size of the specimen and the bending deflection. The stressed specimens were then exposed to a test temperature and a cyclic load of small amplitude applied. Displacements along the length of the beam specimens were then measured and reported.

The stresses and displacements were calculated using the following formula:

$$\sigma_{max}=12\times E\times t\times y/(3\times H^2-4\times A^2) \quad (1)$$

Where:

σ: maximum tensile stress

E: modulus of elasticity=73 GPa t: thickness of specimen=0.0035 m y: maximum displacement H: distance between outer supports=0.180 m A: distance between inner and outer supports=0.045 m Displacement Controlled Tests The displacements shown in below in Tables 1 and 3 were kept constant during the tests. The loads were measured at given intervals. The permanent displacement left after the tests was measured along the length of the specimens.

2024 T351 Aluminium Alloy

The displacements applied to the specimens of 2024 T351 aluminium alloy for the stresses selected, as calculated by equation (1), were as follows:

TABLE 1

| Applied Displacements | | |
|---|---|---|
| Stress (MPa) | Max. Displacement (m) | Cyclic Displacement +/− (m) |
| 230 | 0.006684 | |
| 232.5 (230 +/− 2.5) | 0.006756 | 0.000072 |
| 235 (230 +/− 5) | 0.006830 | 0.000146 |

The loadings applied were:

$$\sigma_{\max} = \frac{3\times A\times W}{b\times d^2} \quad (2)$$

Where: W: Load (MN)

A: Distance between inner and outer supports b: Specimen width (0.05 m)

d: Specimen thickness (0.0035 m)

TABLE 2

| Applied loads | | |
|---|---|---|
| Stress (MPa) | W load (KN) | Cyclic load +/− (KN) |
| 230 | 1.044 | |
| 232.5 | 1.055 | 0.011 |
| 235 | 1.066 | 0.022 |

7150 W51 Aluminium Alloy

The Displacements applied to the specimens of 7150 W51 aluminium alloy and for the stresses selected, as calculated by equation (1), were as follows:

TABLE 3

| Applied Displacements | | |
|---|---|---|
| Stress (MPa) | Max. Displacements (m) | Cyclic Displacement +/− (m) |
| 350 | 0.01017 | |
| 352.5 (350 +/− 2.5) | 0.010244 | 0.000074 |
| 355 (350 +/− 5) | 0.0103165 | 0.0001465 |

The loadings applied as calculated by equation (2) were:

TABLE 4

| Applied loads | | |
|---|---|---|
| Stress (MPa) | W load (KN) | Cyclic load +/− (KN) |
| 350 | 1.588 | |
| 352.5 (350 +/− 2.5) | 1.6 | 0.012 |
| 255 (350 +/− 5) | 1.611 | 0.023 |

Forming time is defined as the time from the inception of the test until the required time has elapsed. The above tests began when the stressed specimen achieved the required temperature.

The Forming time was 10 hours (±15 minutes). The temperature was 155° C.±5° C.

Load Controlled Tests (7150 W51 Aluminium Alloy)

The load was maintained at 350 MPa in the static test and 350+/−2.5 MPa or +/−5 MPa in the tests with a small cyclic load. The specimens were then left to creep. The Forming time was 10 hours (±15 minutes). The temperature was 155° C.±5° C.

Results

Displacement Controlled Tests

2024 T351 ALLOY

Test 1—Static Load Only 10 hrs at 155° C.

TABLE 5

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.105 | 0.142 | 0.16 | 0.102 |
| After Test | 0 | 0.295 | 0.412 | 0.34 | 0.05 |

TABLE 6

| Load Relaxation | | |
|---|---|---|
| Time (hrs) | Load (KN) | Stress (MPa) |
| 0 | 1.04 | 230 |
| 1 | 0.75 | 165 |
| 2 | 0.67 | 148 |
| 3 | 0.64 | 141 |

TABLE 6-continued

| Load Relaxation | | |
|---|---|---|
| Time (hrs) | Load (KN) | Stress (MPa) |
| 4 | 0.62 | 137 |
| 5 | 0.62 | 137 |
| 6 | 0.62 | 137 |

Test 2—Static Load plus +/−2.5 MPa cyclic load—25 Hz 10 hrs at 155° C.

TABLE 7

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.06 | 0.072 | 0.09 | 0.04 |
| After Test | 0 | 0.285 | 0.405 | 0.34 | 0.05 |

TABLE 8

| Load Relaxation | | |
|---|---|---|
| Time (hrs) | Load (KN) | Stress (MPa) |
| 0 | 1.04 | 230 |
| 1 | 0.78 | 172 |
| 2 | 0.67 | 148 |
| 3 | 0.64 | 141 |
| 4 | 0.64 | 141 |
| 5 | 0.64 | 141 |
| 6 | 0.64 | 141 |

Test 3—Static Load plus +/−2.5 MPa cyclic load—50 Hz 10 hrs at 155° C.

TABLE 9

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.135 | 0.155 | 0.107 | −0.05 |
| After Test | 0 | 0.36 | 0.463 | 0.32 | −0.055 |

TABLE 10

| Load Relaxation | | |
|---|---|---|
| Time (hrs) | Load (KN) | Stress (MPa) |
| 0 | 1.043 | 230 |
| 1 | 0.78 | 172 |
| 2 | 0.69 | 152 |
| 3 | 0.66 | 146 |
| 4 | 0.65 | 143 |
| 5 | 0.65 | 143 |
| 6 | 0.65 | 143 |

Test 4—Static Load plus +/−5 MPa cyclic load—25 Hz 10 hrs at 155° C.

TABLE 11

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.0125 | 0.0175 | −0.03 | −0.04 |
| After Test | 0 | 0.19 | 0.276 | 0.162 | −0.06 |

TABLE 12

| Load Relaxation | | |
|---|---|---|
| Time (hrs) | Load (KN) | Stress (MPa) |
| 0 | 1.043 | 230 |
| 1 | 0.79 | 174 |
| 2 | 0.69 | 152 |
| 3 | 0.64 | 141 |
| 4 | 0.63 | 139 |
| 5 | 0.63 | 139 |
| 6 | 0.63 | 139 |

Test 5—Static Load plus +/−5 MPa cyclic load—50 Hz 10 hrs at 155° C.

TABLE 13

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.0225 | 0.02 | 0.00 | −0.05 |
| After Test | 0 | 0.305 | 0.401 | 0.3 | −0.05 |

TABLE 14

| Load Relaxation | | |
|---|---|---|
| Time (hrs) | Load (KN) | Stress (MPa) |
| 0 | 1.042 | 230 |
| 1 | 0.83 | 183 |
| 2 | 0.71 | 156 |
| 3 | 0.67 | 148 |
| 4 | 0.65 | 143 |
| 5 | 0.65 | 143 |
| 6 | 0.65 | 143 |

Repeated Test

Test 4A—Static Load plus +/−5 MPa cyclic load—25 Hz 10 hrs at 155° C.

TABLE 15

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.03 | 0.025 | 0.04 | 0.02 |
| After Test | 0 | 0.210 | 0.285 | 0.220 | 0.05 |

TABLE 16

| Load Relaxation | | |
|---|---|---|
| Time (hrs) | Load (KN) | Stress (MPa) |
| 0 | 1.046 | 230 |
| 1 | 0.81 | 179 |
| 2 | 0.69 | 152 |
| 3 | 0.66 | 145 |
| 4 | 0.64 | 141 |
| 5 | 0.64 | 141 |
| 6 | 0.63 | 139 |

The Stress Relaxation with Ageing Time results from displacement control tests carried out on 2024 T351 aluminium alloy for ten hours at 155° C. plus or minus 5° C. are shown in a graphical representation in FIG. 1.

7150 W51 ALLOY

Test 1—Static Load Only 10 hrs at 155° C.

TABLE 17

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | −0.015 | 0 | 0.03 | 0.05 |
| After Test | 0 | 1.465 | 2.17 | 1.645 | 0.16 |

TABLE 18

| Load Relaxation | | |
|---|---|---|
| Time (hrs) | Load (KN) | Stress (MPa) |
| 0 | 1.585 | 350 |
| 1 | 1.453 | 320 |
| 2 | 1.361 | 300 |
| 3 | 1.333 | 294 |
| 4 | 1.302 | 287 |
| 5 | 1.288 | 284 |
| 6 | 1.287 | 284 |

Test 2—Static Load plus +/−2.5 MPa cyclic load—25 Hz 10 hrs at 155° C.

TABLE 19

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.005 | 0 | −0.02 | −0.04 |
| After Test | 0 | 1.43 | 2.09 | 1.55 | 0.025 |

TABLE 20

| Load Relaxation | | |
|---|---|---|
| Time (hrs) | Load (KN) | Stress (MPa) |
| 0 | 1.585 | 350 |
| 1 | 1.270 | 280 |
| 2 | 1.155 | 255 |
| 3 | 1.097 | 242 |
| 4 | 1.079 | 238 |
| 5 | 1.071 | 236 |
| 6 | 1.060 | 234 |
| 7 | 1.053 | 232 |
| 8 | 1.047 | 231 |

Test 3—Static Load plus +/−5 MPa cyclic load—25 Hz 10 hrs at 155° C.

TABLE 21

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.13 | 0.1 | 0.05 | −0.075 |
| After Test | 0 | 1.40 | 2.03 | 1.485 | 0.01 |

TABLE 22

| Load Relaxation | | |
|---|---|---|
| Time (hrs) | Load (KN) | Stress (MPa) |
| 0 | 1.589 | 350 |
| 1 | 1.166 | 257 |
| 2 | 0.972 | 214 |
| 3 | 0.912 | 201 |
| 4 | 0.872 | 192 |
| 5 | 0.851 | 188 |
| 6 | 0.837 | 184 |
| 7 | 0.828 | 182 |
| 8 | 0.825 | 182 |

Test 4—Static Load plus +/−2.5 MPa cyclic load—50 Hz 10 hrs at 155° C.

TABLE 23

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.145 | 0.155 | 0.04 | −0.085 |
| After Test | 0 | 1.640 | 2.32 | 1.58 | −0.05 |

TABLE 24

| Load Relaxation | | |
|---|---|---|
| Time (hrs) | Load (KN) | Stress (MPa) |
| 0 | 1.554 | 350 |
| 1 | 1.302 | 287 |
| 2 | 1.141 | 251 |
| 3 | 1.110 | 245 |
| 4 | 1.088 | 240 |
| 5 | 1.070 | 236 |
| 6 | 1.058 | 233 |
| 7 | 1.050 | 231 |
| 8 | 1.045 | 230 |

Test 5—Static Load plus +/−5 MPa cyclic load—50 Hz 10 hrs at 155° C.

TABLE 25

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.2 | 0.28 | 0.2 | 0 |
| After Test | 0 | 1.22 | 1.81 | 1.35 | 0.08 |

TABLE 26

| Load Relaxation | | |
|---|---|---|
| Time (hrs) | Load (KN) | Stress (MPa) |
| 0 | 1.587 | 350 |
| 1 | 1.116 | 246 |
| 2 | 1.027 | 226 |
| 3 | 0.987 | 218 |
| 4 | 0.968 | 213 |

TABLE 26-continued

| Load Relaxation | | |
|---|---|---|
| Time (hrs) | Load (KN) | Stress (MPa) |
| 5 | 0.962 | 212 |
| 6 | 0.958 | 211 |
| 7 | 0.948 | 209 |
| 8 | 0.942 | 208 |

Figure 2:
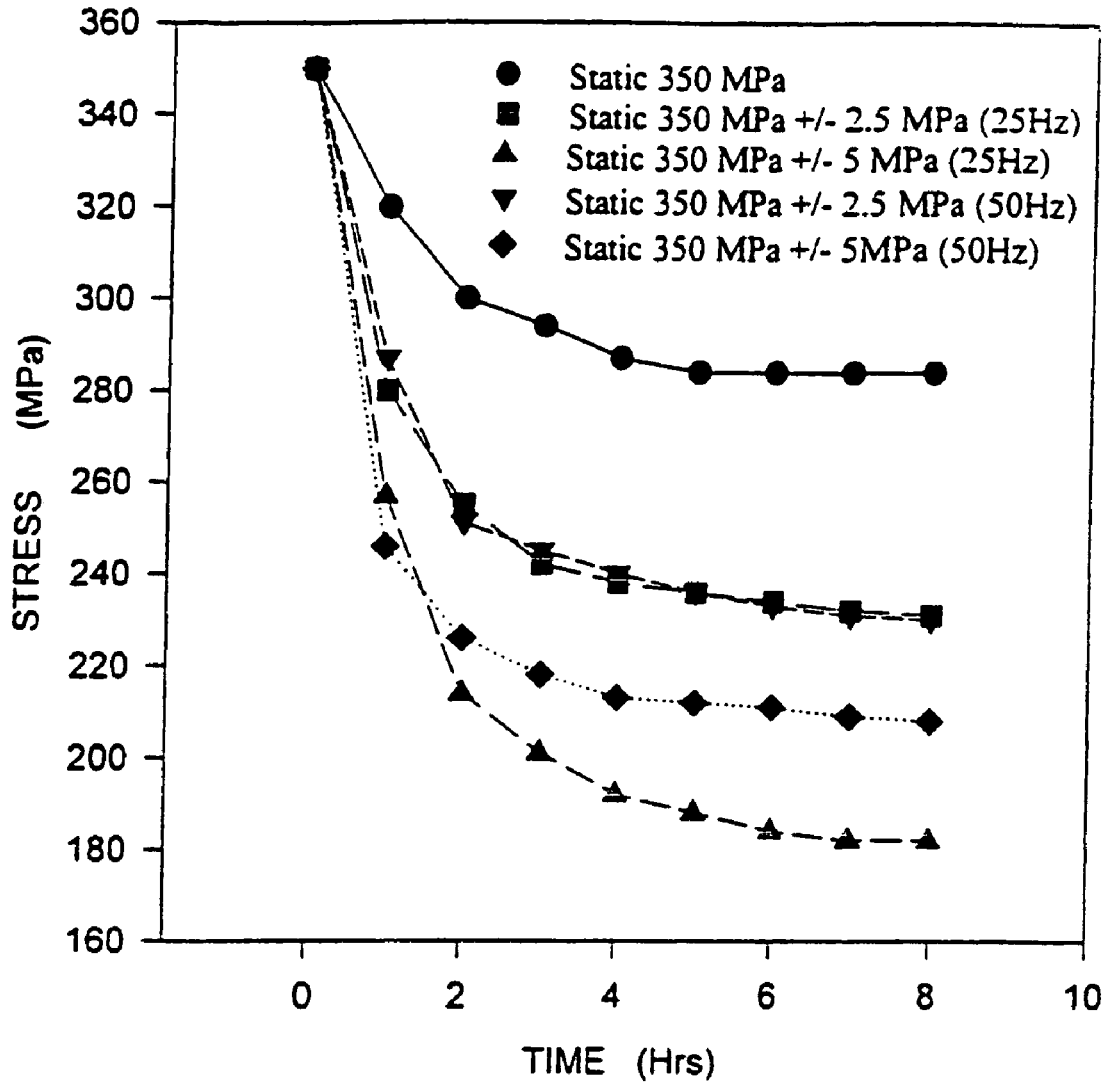
FIG. 2 is a graphical representation of the Stress Relaxation with Ageing Time results from displacement control tests carried out on 7150 W51 aluminium alloy for ten hours at 155° C. plus or minus 5° C.

The Stress Relaxation with Ageing Time results from displacement control tests carried out on 7150 W51 aluminium alloy for ten hours at 155° C. plus or minus 5° C. are shown in a graphical representation in FIG. 2.

7150 W51 Aluminium Alloy Load Controlled Tests

7150 W51 ALLOY

Load Control (Load 1.588 KN)

Test 1—Static Load Only 10 hrs at 155° C.

TABLE 27

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.42 | 0.66 | 0.57 | 0.06 |
| After Test | 0 | 2.95 | 4.14 | 3.19 | 0.26 |

TABLE 28

| Displacement vs Time | | |
|---|---|---|
| Time (hrs) | Actuator position (mm) | Displacement (mm) |
| 0 | 1.127 | 0 |
| 1 | −0.504 | 1.631 |
| 1.5 | −0.936 | 2.063 |
| 2 | −1.225 | 2.352 |
| 3 | −1.4012 | 2.528 |
| 4 | −1.631 | 2.758 |
| 5 | −1.852 | 2.979 |
| 6 | −2.043 | 3.17 |
| 7 | −2.181 | 3.308 |

Note This specimen was initially loaded for 15 min at 155° C. to a stress of 230 MPa. The specimen was then unloaded, cooled to room temperature and the test re-started as above. Hence the initial curvature of 0.66 mm at the centre.

Load Control (Load 1.588 KN)

Test 2—Static Load plus +/−2.5 MPa cyclic load—25 Hz 10 hrs at 155° C.

TABLE 29

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.33 | 0.43 | 0.25 | −0.03 |
| After Test | 0 | 2.22 | 3.14 | 2.145 | −0.04 |

TABLE 30

| Displacement vs Time | | |
|---|---|---|
| Time (hrs) | Actuator position (mm) | Displacement (mm) |
| 0 | 1.454 | 0 |
| 1 | 0.416 | 1.038 |
| 2 | −0.0673 | 1.521 |
| 3 | −0.2665 | 1.72 |
| 4 | −0.3625 | 1.816 |
| 5 | −0.4431 | 1.897 |
| 6 | −0.4413 | 1.895 |
| 7 | −0.5544 | 2.001 |

Load Control (Load 1.588 KN)

Test 3—Static Load plus +/−5 MPa cyclic load—25 Hz 10 hrs at 155° C.

TABLE 31

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.145 | 0.2 | 0.125 | 0.03 |
| After Test | 0 | 1.65 | 2.305 | 1.685 | 0.09 |

TABLE 32

| Displacement vs Time | | |
|---|---|---|
| Time (hrs) | Actuator position (mm) | Displacement (mm) |
| 0 | 3.331 | 0 |
| 1 | 2.184 | 1.147 |
| 2 | 2.122 | 1.209 |
| 3 | 1.953 | 1.378 |
| 4 | 1.883 | 1.448 |
| 5 | 1.809 | 1.552 |
| 6 | 1.734 | 1.597 |
| 7 | 1.690 | 1.641 |
| 8 | 1.673 | 1.658 |
| 9 | 1.645 | 1.686 |

Load Control (Load 1.588 KN)

Test 4 (Repeat of Test 2)—Static Load plus +/−2.5 MPa cyclic load—25 Hz 10 hrs at 155° C.

TABLE 33

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.022 | 0.0725 | 0.095 | 0.095 |
| After Test | 0 | 1.59 | 2.29 | 1.62 | 0.115 |

TABLE 34

| Displacement vs Time | | |
|---|---|---|
| Time (hrs) | Actuator position (mm) | Displacement (mm) |
| 0 | 2.357 | 0 |
| 1 | 0.6209 | 1.736 |
| 2 | 0.086 | 2.271 |
| 3 | −0.3268 | 2.684 |
| 4 | −0.2934 | 2.65 |
| 5 | −0.3097 | 2.667 |
| 6 | −0.4321 | 2.789 |
| 7 | −0.5198 | 2.877 |

Load Control (Load 1.588 KN)

Test 5 (Repeat of Test 3)—Static Load plus +/−5 MPa cyclic load—25 Hz 10 hrs at 155° C.

TABLE 35

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.055 | 0.085 | 0.095 | 0.075 |
| After Test | 0 | 1.00 | 1.435 | 1.075 | 0.05 |

TABLE 36

| Displacement vs Time | | |
|---|---|---|
| Time (hrs) | Actuator position (mm) | Displacement (mm) |
| 0 | 2.475 | 0 |
| 1 | 0.8531 | 1.622 |
| 2 | 0.6984 | 1.777 |
| 3 | 0.3650 | 2.11 |
| 4 | −0.3936 | 2.869 |

Note: The machine shut down after 4 hrs testing

Load Control (Load 1.588 KN)

Test 6—Static Load plus +/−2.5 MPa cyclic load—40 Hz 10 hrs at 155° C.

TABLE 37

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.13 | 0.17 | 0.13 | −0.01 |
| After Test | 0 | 1.565 | 2.17 | 1.55 | 0.03 |

TABLE 38

| Displacement vs Time | | |
|---|---|---|
| Time (hrs) | Actuator position (mm) | Displacement (mm) |
| 0 | 2.061 | 0 |
| 1 | 0.7958 | 1.265 |
| 2 | 0.3590 | 1.702 |
| 3 | 0.1265 | 1.935 |
| 4 | 0.7396 | 1.321 |
| 5 | 0.6557 | 1.405 |
| 6 | 0.6336 | 1.427 |
| 7 | 0.6373 | 1.424 |

Note: The frequency was 40 Hz (instead of 50 Hz) due to instability on the signal at 50 Hz.

Load Control (Load 1.588 KN)

Test 7—Static Load plus +/−5 MPa cyclic load—40 Hz 10 hrs at 155° C.

TABLE 39

| Specimen Displacements (mm) | | | | | |
|---|---|---|---|---|---|
| | Distance from edge (mm) | | | | |
| | 45 | 90 | 125 (centre) | 170 | 215 |
| Before Test | 0 | 0.07 | 0.08 | 0.025 | −0.105 |
| After Test | 0 | 2.7 | 3.88 | 2.83 | 0.04 |

TABLE 40

| Displacement vs Time | | |
|---|---|---|
| Time (hrs) | Actuator position (mm) | Displacement (mm) |
| 0 | 1.962 | 0 |
| 1 | −3.094 | 5.056 |
| 2 | −3.247 | 5.209 |
| 3 | −3.580 | 5.542 |
| 4 | −3.629 | 5.591 |
| 5 | −3.764 | 5.726 |
| 6 | −3.892 | 5.854 |
| 7 | −3.900 | 5.862 |

Note: The frequency was 40 Hz (instead of 50 Hz) due to instability on the signal at 50 Hz.

Figure 3:
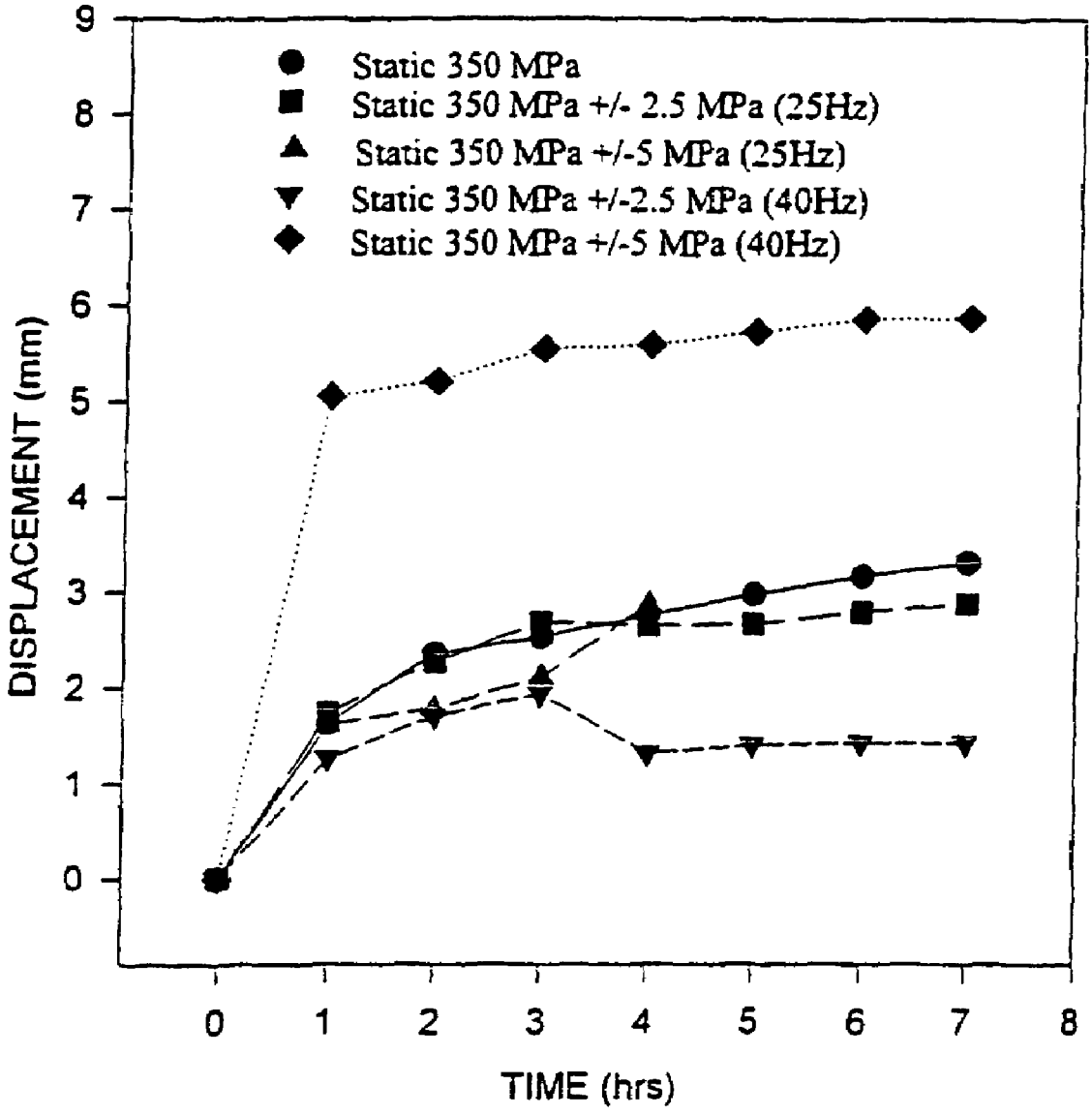
FIG. 3 is a graphical representation of the Creep Displacement with Ageing Time results from displacement control tests carried out on 7150 W51 aluminium alloy for ten hours at 155° C. plus or minus 5° C.

Creep Displacement with Ageing Time results from displacement control tests carried out on 7150 W51 aluminium alloy for ten hours at 1550C plus or minus 50C are shown in a graphical representation in FIG. 3.

Figure 4:
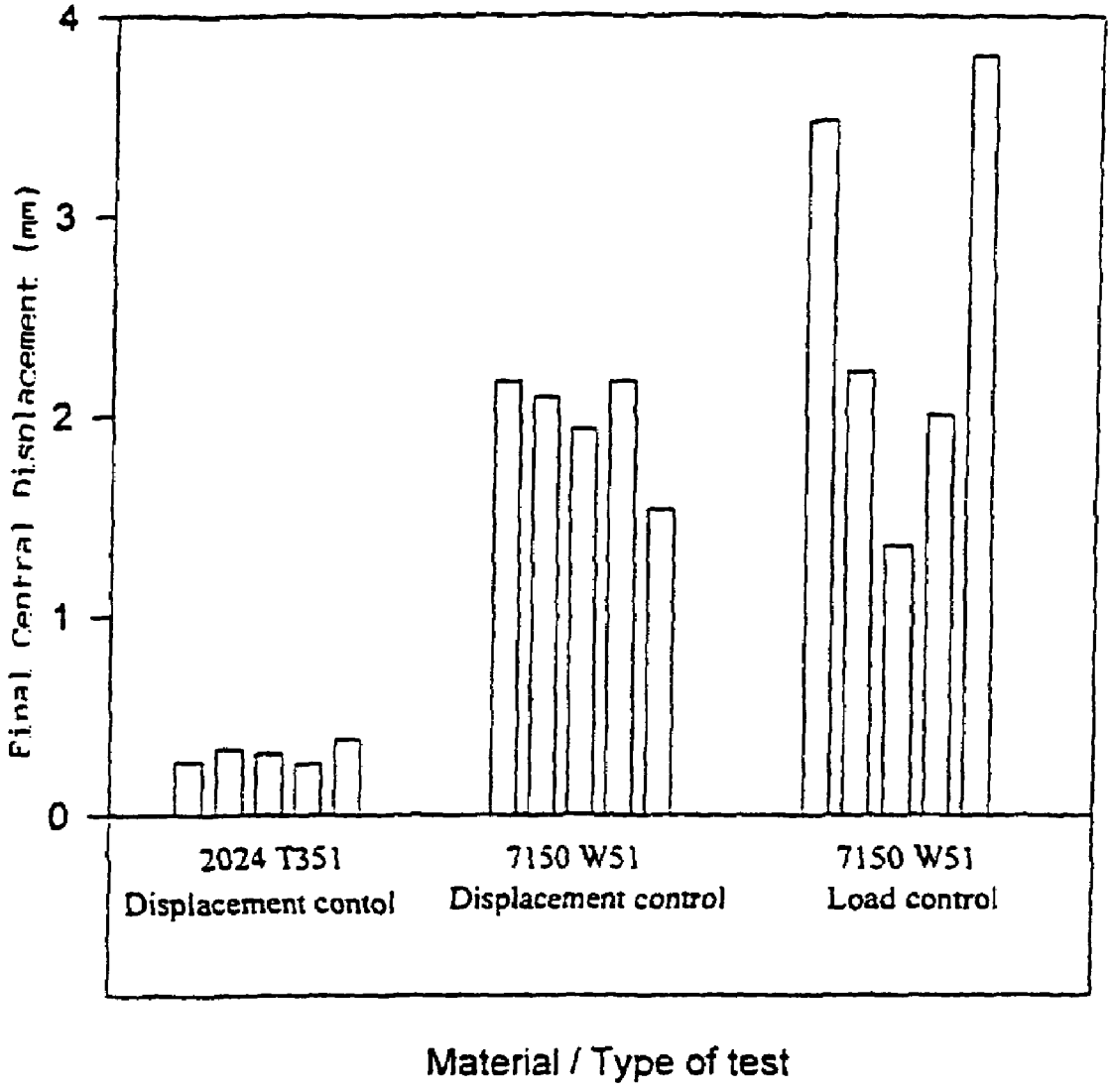
FIG. 4 is a graphical representation of the total Creep Ageing Displacement left after the tests represented in FIGS. 1-3.

The data showing the permanent displacement left at the end of all of the tests is shown graphically in FIG. 4.

Observations

From the results of the displacement controlled tests outlined above and it was observed that there was very little influence of the small amplitude cyclic loading is observed on the age-forming of 2024 T351 Aluminium Alloy. This can be seen clearly from the graphical representation at FIG. 1. The specimen subjected to static loading alone creep-aged at approximately the same rate as those that also included a small amplitude cyclic loading.

Conversely, the 7150 W51 Aluminium Alloy displacement controlled tests results showed a definite effect of the small cyclic loading on the creep-aged rate as illustrated in FIG. 2. For example, the stress relaxed to a low value of 180 MPa from an initial stress of 350 MPa when the loading included small amplitude cycling (+/−5 MPa (25 Hz)) while, with static loading alone, it relaxed from an initial stress of 350 MPa to only 284 MPa in the same time span.

From these results it also seems possible that the magnitude of the stress relaxation is dominated by the range of the small amplitude cycles, i.e. the +/−5 MPa tests showed a larger stress relaxation than the +/−2.5 MPa.

In the Load Controlled Tests indicate results showed that the specimen tested at +/−5 MPa and 40 Hz frequency showed a substantially higher creep elongation than the other specimens tested. Thus a combination of cyclic amplitude and high frequency seems to produce higher creep elongation.

The graphical representation of the permanent deflection left at the end of all of the tests as shown in FIG. 4, clearly shows that the 7150 W51 Aluminium Alloy retained a much higher permanent deflection than the 2024 T351 Aluminium Alloy after the Displacement Controlled tests.

The data from the load controlled tests showed a much higher scatter than that from the displacement controlled tests. It should be noted that the very low amplitude cyclic loading was very difficult to control because they were of the same magnitude as the noise, this can explain the larger scatter in the results of in this type of test.

Discussion

7150 Aluminium Alloy seems to age-creeps more readily than 2024 Aluminium Alloy. This may be the result of two factors. Firstly, the stresses applied to the 7150 W51 Aluminium Alloy were higher than those applied to the 2024 T351 Aluminium Alloy (350 MPa against 230 MPa). Obviously, 7150 Aluminium Alloy being a stronger material than the 2024 Aluminum Alloy can be subjected to higher stresses. For example, the ratio of the yield stresses when fully aged are 1.63 while the ratios of the applied stresses in the tests was 1.52. Secondly, the is 2024 Aluminium Alloy was already aged to a temper T351 while the 7150 Aluminium Alloy was not artificially aged prior to testing. This means that the 7150 Aluminium alloy material tested was initially softer than the 2024 Aluminium Alloy fully aged material tested, which may result in a higher creep rate than may be anticipated by the ratio of 1.52 mentioned above.

From these results the potential for a method of creep forming metallic components including a step of applying cyclic loading/vibration is very good. Such a technique will enable large components to be creep formed economically, whilst maintaining the necessary accuracy and thus keeping the component within the required tolerance.

The invention claimed is:

1. A method of creep forming a metallic component including the steps of applying a static loading and a cyclic loading to the component during the creep forming thereof, wherein the magnitude of the cyclic loading is less than or equal to 10% of the magnitude of the static loading, wherein the cyclic loading has a frequency of 1 Hz to 1,000 Hz.

2. A method of creep forming a metallic component as in claim 1 wherein the magnitude of the cyclic loading is less than or equal to 5% of the magnitude of the static loading.

3. A method of creep forming a metallic component as in claim 2 wherein the magnitude of the cyclic loading is less than or equal to 2% of the magnitude of the static loading.

4. A method of creep forming a metallic component as in claim 3 wherein the magnitude of the cyclic loading is less than or equal to 1% of the magnitude of the static loading.

5. A method of creep forming a metallic component as in claim 1 wherein a portion of the cyclic loading is vibration.

6. A method of creep forming a metallic component as in claim 1 wherein the cyclic loading has a frequency of 10 Hz to 100 Hz.

7. A method of creep forming a metallic component as in claim 6 wherein the cyclic loading has a frequency of 20 Hz to 50 Hz.

8. A method of creep forming a metallic component as in claim 1 wherein the metallic component is formed from a metal alloy.

9. A method of creep forming a metallic component as in claim 8 wherein the metal alloy is an aluminium alloy.

10. A method of creep forming a metallic component as in claim 1 wherein the metallic component is creep formed during a final stage of heat treatment of a material from which the metallic component is formed.

11. A method of creep forming a metallic component including the steps of applying a static loading and a cyclic loading to the component during the creep forming thereof, wherein the magnitude of the cyclic loading is less than or equal to 10% of the magnitude of the static loading, wherein the cyclic loading is applied to a discrete portion of the component and the cyclic loading is applied to successive portions of the component until substantially the whole component has been creep formed.

12. A method of creep forming a metallic component as in claim 11 in which a said discrete portion of the component is a zone of structural reinforcement of the component.

13. A method of creep forming a metallic component including the steps of:

applying a static loading on the order of 350 MPa; and simultaneously with the application of said static loading, applying a cyclic loading at a frequency on the order of 40 Hz and a loading on the order of ±5 MPa to the component during the creep forming thereof.

14. A method of creep forming a metallic component according to claim 13, wherein said metallic component is an aluminum alloy.

15. A method of creep forming a metallic component according to claim 14, wherein said aluminum alloy is 7150 W51 aluminum alloy.

* * * * *